US009084703B1

(12) United States Patent
Fair et al.

(10) Patent No.: US 9,084,703 B1
(45) Date of Patent: Jul. 21, 2015

(54) FECAL AND URINARY MANAGEMENT SYSTEM FOR BEDRIDDEN PERSONS

(71) Applicants: Ron G. Fair, Brighton, CO (US); David Fair, Harvard, MA (US)

(72) Inventors: Ron G. Fair, Brighton, CO (US); David Fair, Harvard, MA (US)

( * ) Notice: Subject to any disclaimer, the term of this patent is extended or adjusted under 35 U.S.C. 154(b) by 0 days.

(21) Appl. No.: 14/184,106

(22) Filed: Feb. 19, 2014

(51) Int. Cl.
*A47B 13/00* (2006.01)
*A61G 7/02* (2006.01)

(52) U.S. Cl.
CPC ..... *A61G 7/02* (2013.01)

(58) Field of Classification Search
CPC ..... A61G 7/02; A61G 7/015; A61G 7/0005
USPC ..... 5/604–606, 695, 485, 487; 383/83–86, 383/109, 113
See application file for complete search history.

(56) References Cited

U.S. PATENT DOCUMENTS

| | | | | | |
|---|---|---|---|---|---|
| 801,865 | A | | 10/1905 | Hall et al. | |
| 1,054,452 | A | | 2/1913 | Sayen | |
| 3,772,712 | A | * | 11/1973 | Renn et al. | 4/484 |
| 3,849,811 | A | * | 11/1974 | Cyll | 5/604 |
| 4,368,733 | A | | 1/1983 | Sanidas | |
| 4,417,669 | A | * | 11/1983 | Knowles et al. | 221/26 |
| 4,424,051 | A | * | 1/1984 | Lee et al. | 493/37 |
| 4,677,700 | A | * | 7/1987 | Su | 5/604 |
| 4,784,656 | A | * | 11/1988 | Christian | 604/355 |
| 4,847,932 | A | | 7/1989 | Baribault, Jr. | |
| 4,949,409 | A | | 8/1990 | Stefano | |
| 4,974,270 | A | | 12/1990 | Kuhn | |
| 5,077,845 | A | | 1/1992 | Tokunaga et al. | |
| 5,236,135 | A | * | 8/1993 | Wilson et al. | 241/21 |
| 5,901,390 | A | | 5/1999 | Williams | |
| 6,243,898 | B1 | | 6/2001 | Ruff | |
| 6,931,684 | B1 | * | 8/2005 | Henegar | 5/695 |
| 7,836,525 | B2 | | 11/2010 | Castillo et al. | |
| 8,225,443 | B2 | | 7/2012 | Stefano et al. | |
| 8,522,999 | B2 | * | 9/2013 | Licata | 220/495.07 |
| 2002/0088738 | A1 | * | 7/2002 | Malone et al. | 206/554 |
| 2002/0189018 | A1 | | 12/2002 | Hayes | |
| 2004/0222264 | A1 | * | 11/2004 | Tan | 225/106 |
| 2010/0101023 | A1 | * | 4/2010 | Stephens et al. | 5/604 |
| 2010/0125951 | A1 | * | 5/2010 | Stefano et al. | 5/604 |
| 2013/0086737 | A1 | * | 4/2013 | Bizar | 4/484 |
| 2014/0042168 | A1 | * | 2/2014 | Dunn et al. | 220/495.05 |
| 2015/0040325 | A1 | * | 2/2015 | Bennett | 5/691 |

FOREIGN PATENT DOCUMENTS

| | | |
|---|---|---|
| CN | 2052271 U | 2/1990 |
| CN | 2248555 Y | 3/1997 |

(Continued)

*Primary Examiner* — Robert G Santos
*Assistant Examiner* — Myles Throop
(74) *Attorney, Agent, or Firm* — Marsh Fischmann & Breyfogle LLP

(57) ABSTRACT

Presented is a fecal/urine management system that includes a mattress having an aperture (e.g., catchment aperture) disposed through its top surface. The catchment aperture allows positioning a patient's anus over the aperture when the patient is positioned on the mattress. Accordingly, bodily waste may be collected in the aperture and thus separated from the skin of the patient. To prevent soiling the mattress, a catchment insert is positioned within the catchment aperture. The catchment insert, in one embodiment, includes an annular platform that rests on the top surface of the mattress and catchment bag that is adapted to be positioned within the mattress aperture. The catchment bag and annular platform prevent most or all bodily waste from contacting the mattress. Further, the catchment bag is adapted for removal through the top surface of the mattress with little or no movement of the patient.

10 Claims, 7 Drawing Sheets

(56) References Cited

FOREIGN PATENT DOCUMENTS

| | | | |
|---|---|---|---|
| CN | 201230941 | Y | 5/2009 |
| CN | 201481702 | U | 5/2010 |
| CN | 202336004 | U | 7/2012 |
| CN | 202526448 | U | 11/2012 |
| EP | 2399561 | A1 | 6/2010 |
| GB | 1042978 | | 11/1964 |

* cited by examiner

FECAL AND URINARY MANAGEMENT SYSTEM FOR BEDRIDDEN PERSONS

FIELD

The presented inventions are broadly directed to fecal and urinary hygienic care of bedridden persons. More specifically, the presented inventions are directed to a fecal continence and incontinence management system for bedridden persons. Such a system will prevent entrapment of human waste, feces and urine, against the genitals and skin of the person; which facilitates cleaning of bedridden persons.

BACKGROUND

Statistical data from the NIH states that 18 million U.S. adults suffer from fecal incontinence and are in need of methods to manage bowel function. At the present time there are over 1.3 million persons who are residents in certified nursing facilities in the United States. In addition to those in care centers there are an estimated 500,000 persons in Hospice care. An additional unknown number of persons are bedridden in private residences with private or family member care. The total number of persons requiring fecal incontinent care in the U.S.A. is approximated at well over 2,000,000. Of this population segment, a large percentage are non-ambulatory and bedridden.

When people who have been ambulatory in everyday life are confined to bed, the management of urine and bowel function becomes a major issue. In the 2010 Kaiser Family Foundation report titled, "Total Number of Residents in Certified Nursing Facilities" included a list from Certified Nursing Facilities highlighting the Top Ten Deficiencies. In priority order these were:

1. Quality of Care,
2. Infection Control,
3. Professional Standards, and
4. Dignity.

Kaiser cited privacy, embarrassment, social mores, respect, and self image as contributing factors leading to clinical depression in the bedridden.

There is a need for new art that will deliver improved methods of fecal and urine disposal for the bedridden. Continent people may be able to use a bedpan however; bedpans are very uncomfortable and unsatisfactory for extended use; particularly for the incontinent who are unable to time bowel movements. Frequently these persons are placed in diapers and become subjected to four major problems associated with wearing diapers.

First, diapers trap and mix fecal and urinary discharges against the skin, and genitalia of both male and female persons.

Second, diapers introduce an environment in which it is difficult to maintain clean and healthy skin, Third, the psychological impact on a person with a sound mind usually result in embarrassment and depression, and Fourth, the onset of depression requires treatment with anti depressant medications. These medications frequently create constipation resulting in impacted stool for bedridden persons; further complicating and aggravating the care situation.

Trapping Feces and Urine Against the Skin:

Diapers manage urinary and fecal discharge as a single system. By failing to separate urinary and fecal discharge from contact with the person, diapers enable a toxic mixture of urinary and fecal material to envelop and/or penetrate the genitalia, creating an environment where sanitation concerns are paramount and cleanliness is difficult to achieve. Stated otherwise, trapping fecal and urinary discharges against the skin results in skin irritation and breakdown, which increase the risk of potentially painful or dangerous Incontinence Associated Dermatitis (IAD), urinary infections, chronic disease tissues and ulcers. In females, fecal contamination of the labia, vagina, urethra and/or anus present extremely unhealthy risks leading to frequent urinary tract infections.

Maintaining Clean and Healthy Skin:

Each nursing facility has procedures in place to provide changing of diapers when they become wet or contain a bowel movement. The guidelines for perineal care in some nursing homes require at least 31 steps for the female and 30 steps for the male. The in-service training process for new employees requires several hours of training to become certified. Due to the undesirable nature of the perineal cleanup process and staffing shortages at many nursing homes, it is not uncommon for the cleanup process to be delayed or steps in the procedures be forgotten or ignored. That is, the bedridden person may remain soiled for an extended period increasing the likelihood of skin irritation issues. Accordingly, it is desirable to provide a solution that reduces the cleanup burden imposed by diapers while reducing or eliminating waste contact with the person.

Onset of Depression:

When people who have been ambulatory in everyday life and are suddenly are confronted with a stroke, accident injury or other experience find themselves bedridden on their back it causes a reality shock to them. The management of urine and bowel function creates an physical challenge that predictably and quickly impacts the emotional and mental state of the bedridden.

Medications and Complications for the Bedridden:

Odor containment, embarrassment, withdrawal, and avoidance of visitors is frequently a side effect of wearing diapers; beginning a downward morale spiral leading to depression. Depression is treatable with medicines however; complications of constipation and further physical change in bowel function create a cascade of issues that also need to be managed with medication.

Anticolonergic medications induce constipation that then require stool softeners or laxative be prescribed to induce bowel movements. These same medications alter other body functions. For example, pupil dilation of the eyes and blurred vision resulting in paralysis of ocular accommodation is a common side effect of anticolonergic medications. The inability of the bedridden to read and see, as they are accustomed, contributes significantly to depression.

Diarrhea is a frequent concomitant of this combination of medication and methods to deal with the function of the bowel. The desired balance of bowel function that is normal in healthy individuals is now in a state of induced unpredictable balance; making it difficult for caregivers to establish a care routine for the bedfast. Effectively this medicated state of imbalance has introduced the first stage of concern for continence and or incontinence care.

Stages of Incontinence:

Incontinence, natural or medically induced, pose a series of challenges for caregivers. Bedridden persons span a wide spectrum from alert and cooperative to completely unaware. The progressive stages of incontinence from least to most severe are:

Mental and physical ability to cooperate fully with caregivers. The person is confined to bed for bowel and urine functions but can recognize urges.

Mental and physical ability to cooperate with timing to perform the bowel function on a known schedule.

Mentally capable to cooperate; but unable to have physical control or awareness when bowel function may occur.

Mentally and physically unable to coordinate bowel function on any timing schedule.

Totally unable to assist the care giver in any way when bowel function occurs.

Physically rolling and changing positions frequently without regard to any ongoing bowel function.

Near death with dehydration when bowel function ceased to occur or present caregiver problems.

SUMMARY

The presented fecal and urinary management system is primarily designed for the bedridden incontinent. However, continent persons, injured or otherwise, unable to leave the bed, will also benefit from this invention. The bedridden and their care providers are desperate for hygienic, less time consuming, economically feasible alternatives to diapers or a bedpan for toilet elimination. This system exploits three forces to capture urine and stool: involuntary peristaltic muscle contraction—urge; voluntary muscle contractions by the bedridden—push; and gravity pulling the discharge into the sack—drop. Any, or all of these forces in combination, cause the urine and bowel movements to be captured in a disposable bag that mitigates human waste from remaining in a position against skin tissue and genitalia of male or female bedridden persons.

This fecal/urine management system is designed to provide caregivers with a system to manage each stage of incontinence until the final stage when diapers remains the only practical solution. In addition to the four major problems introduced by wearing diapers progressively less controllable stages of incontinence increase the difficulties of hygienic care, further complicating the task by the caregiver to provide proper care. A bedridden person's ability to have physical control or awareness may deteriorate to the point that they are not longer cooperating with the caregiver.

The fecal/urine management system includes a mattress having an aperture (e.g., catchment aperture) disposed through its top surface. This aperture may have a closed bottom or may extend entirely through the mattress. Generally, the aperture is disposed though a mid portion of the mattress approximately halfway between the sides for the mattress and between the head and foot of the mattress. Variation is possible. The catchment aperture typically has a depth of at least about 8 inches, a width of between about 4 inches and 8 inches and a length of between about 6 inches and 12 inches. The catchment aperture allows positioning a patient's anus over the aperture when the patient is positioned on the mattress. Accordingly, bodily waste may be collected in the aperture and thus separated from the skin of the patient.

To prevent soiling the mattress, a catchment insert is positioned within the catchment aperture. The catchment insert, in one embodiment, includes an annular platform that rests on the tope surface of the mattress. A catchment bag is attached to the annular platform. This catchment bag is adapted to be positioned within the mattress aperture. The catchment bag and annular platform prevent most or all bodily waste from contacting the mattress. Further, the catchment bag is adapted for removal through the top surface of the mattress with little or no movement of the patient.

In a further embodiment, the catchment insert is adapted to be worn by a bedridden patient. In this embodiment, the catchment insert includes a diaper portion worn by the bedridden patient. A catchment bag is incorporated into the diaper about an aperture located proximate to the location of the patient's anus when the diaper is worn. Again, this catchment bag may be disposed in the mattress aperture. This arrangement allows bodily waste to pass out of the diaper and collect in the catchment bag, which is disposed below the patient in the mattress aperture.

In a further arrangement, an absorbent pad may be positioned over the mattress. This absorbent pad further includes a non-permeable liner (e.g., bag) that is adapted for positioning within the mattress aperture. In this arrangement, the catchment bag of the catchment insert may be disposed within the liner of the absorbent pad.

In a further arrangement, a discharge tube or scrotal diaper is further incorporated into the catchment insert to provide a means for catching urine of male patients.

In another aspect a fecal/urine management system is provided that is designed for hygienic care of adult bedridden persons. The fecal/urine management system collects human waste from a roll of disposable catchment bags that deploy from the bottom of a cavity within a mattress. A platform with an aperture is centered over and around the cavity within the mattress. This platform secures an open end of one of catchment bag and centers this catchment bag over the cavity within a mattress. This platform may also secure a male urine pouch that will catch and contain urine. Integral to this design is a mattress with a mattress cavity that holds and dispenses the catchment bags. The mattress cavity and catchment bags are large enough to accommodate stool and urine with enough clearance to mitigate tissue damage and Incontinent Associated Diseases (IAD) introduced by the current ubiquitous use of diapers that trap and mix feces and urine against the skin. This fecal/urine management system may further include bed linens with a hole that will accommodate the mattress cavity. To prevent soiling the mattress and bed linen; a bed pad that also includes a hole that accommodates the shape of the mattress cavity may be deployed beneath the platform and over the mattress and linens. This bed pad is placed over the mattress and bed linen allowing open access to the mattress cavity. The platform with an aperture is mounted on top of the bed pad; over the surface of the mattress and centered on the mattress cavity. The disposable catchment bags are pulled through the platform aperture and over the top and sides of the platform where they are secured to the platform. The bedridden person's anus is positioned over the aperture in the platform. The bodily waste is discharged through the aperture in the platform and captured in the disposable catchment bag. The disposable catchment bag is adapted for removal through the aperture in the platform with little or no movement of the bedridden person. The next disposable capture bag is pulled through the aperture with the removal of the soiled bag. The clean disposable capture bag is detached from the bag containing the human waste and pulled over the top and sides of the platform where they are secured to the platform for the next bowel movement.

DETAILED DESCRIPTION

Reference will now be made to the accompanying drawings, which at least assist in illustrating the various pertinent features of the present invention. The following description is presented for purposes of illustration and description and is not intended to limit the invention to the form disclosed herein. Consequently, variations and modifications commensurate with the following teachings, and skill and knowledge of the relevant art, are within the scope of the present invention. The embodiments described herein are further intended to explain the best modes known of practicing the invention and to enable others skilled in the art to utilize the invention in such, or other embodiments and with various modifications required by the particular application(s) or use(s) of the present invention.

The presented systems and methods mitigate the mixture of fecal and urinary discharges by providing a capture mechanism (e.g., catchment bag) for feces/urine that allows sanitary removal and disposal of the same. The catchment mechanism is separated from the person to prevent fecal contamination of the genitalia and adjacent body tissues, skin and legs of both male and female persons. Specifically, the catchment mechanism is disposed in a mattress cavity below a bedridden person such that the feces and/or urine of the person drops below the person into the catchment mechanism. Such a system improves the sanitary condition of the bedridden and reduces the magnitude of the necessary clean-up by caregivers. Stated otherwise, the capture mechanism allow fecal and/or urinary management for the bedridden to be resolved in a humanely comfortable sanitary manner preserving dignity and overcoming the present system of diapers being worn by bedridden persons. The system is primarily directed to persons who are bedfast and immobile to the extent that they cannot get out of bed to walk to a toilet or use a bedside potty chair. These persons are mostly supine on their back and do not turn unless assisted by a caregiver.

Figure 1:
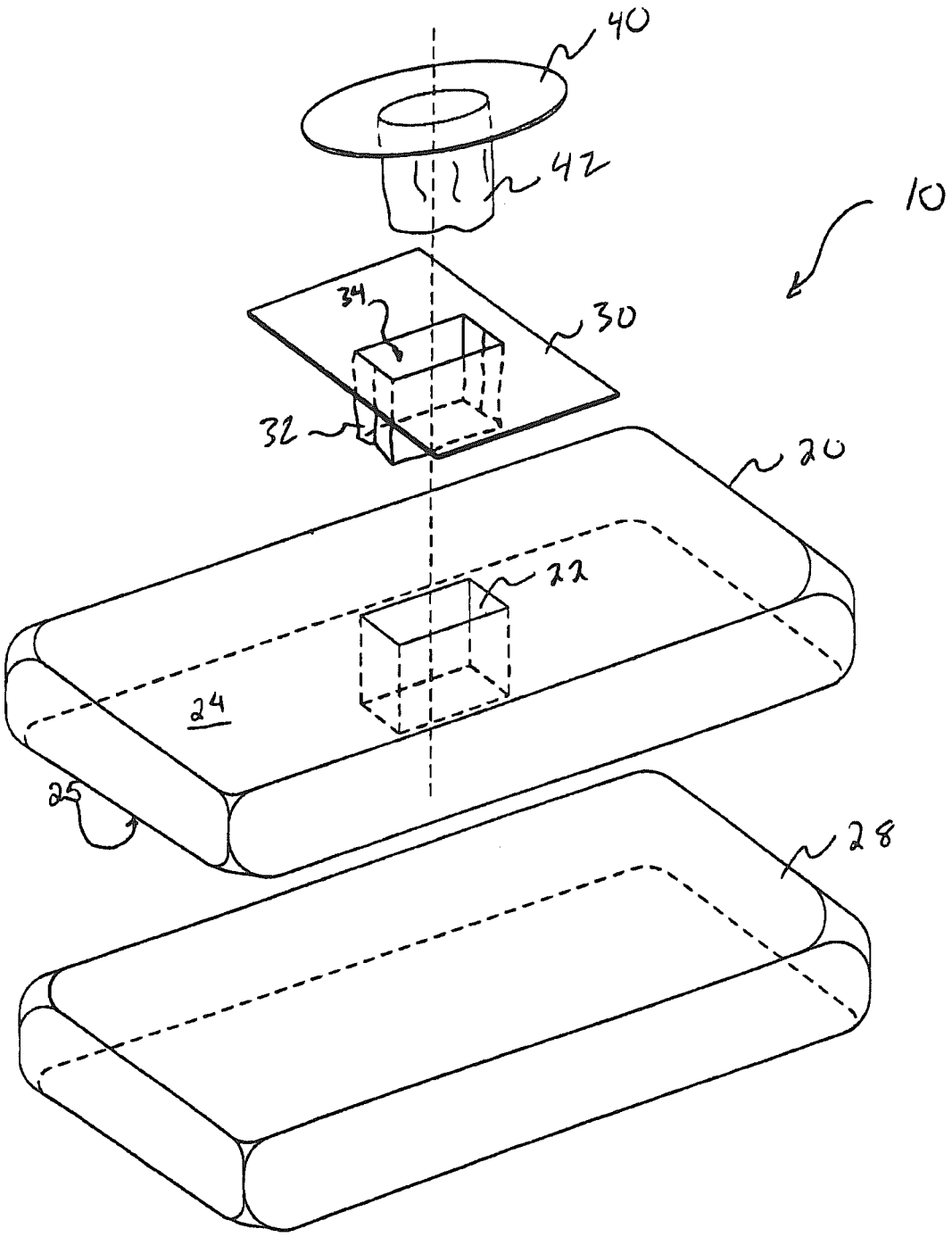
FIG. 1 illustrates a perspective exploded view of one embodiment of a fecal and urinary management system.
Figure 2:
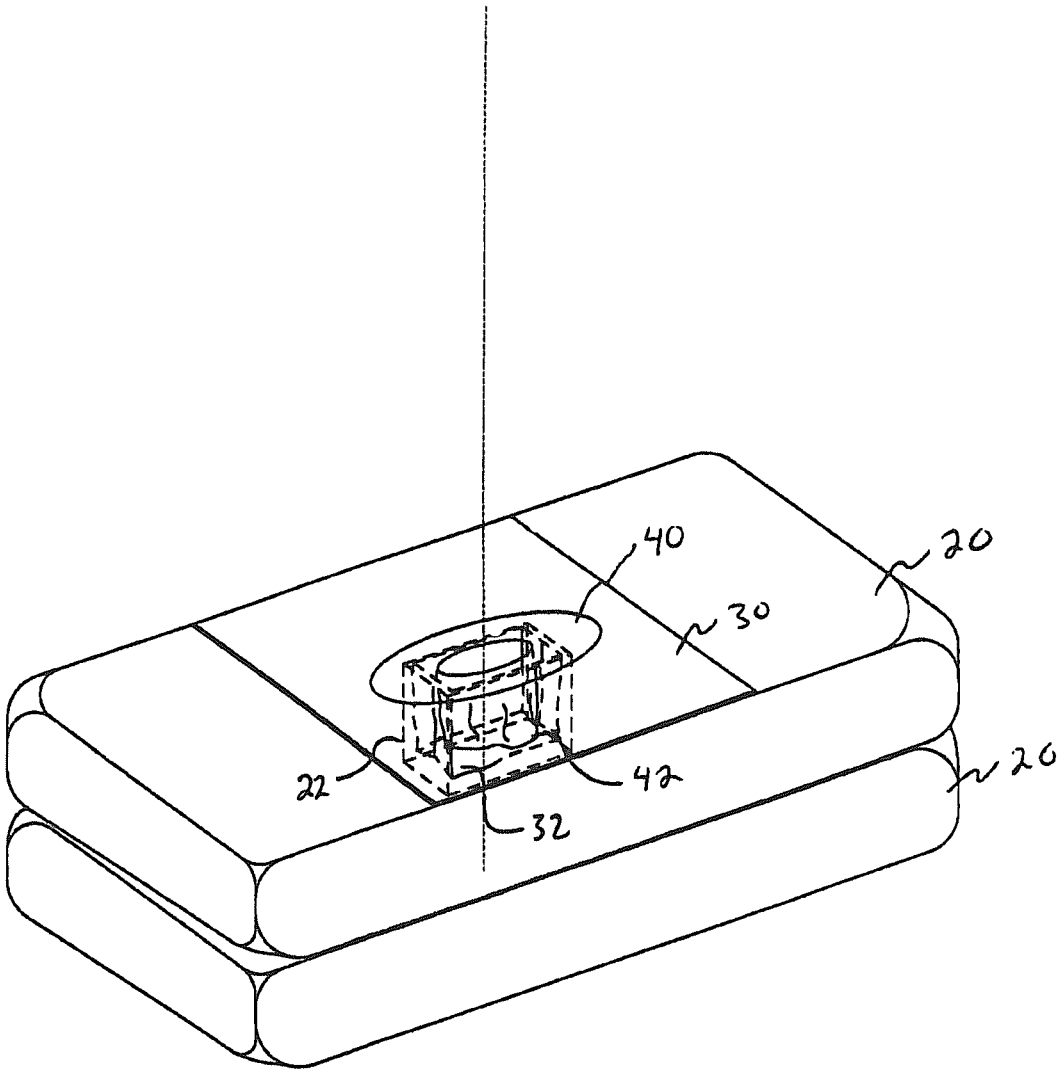
FIG. 2 illustrates a perspective assembled view of the fecal and urinary management system of FIG. 1.

FIGS. 1 and 2 illustrate one exemplary embodiment of a fecal and urinary management system 10 for use with bedridden persons. As shown, the system 10 includes a mattress 20 having a catchment aperture 22. The mattress 20 and catchment aperture 22 are typically lined with a protective moisture barrier or coating to protect the mattress becoming soiled. The system also includes a catchment insert 40 having a catchment bag 42 that receives bodily waste. In one embodiment, the system also incorporates an absorbent pad 30 having a catchment liner 32, however, the system may omit the pad 30 and liner 32. As shown, when utilized with the absorbent pad 30, the pad 30 is disposed on a top surface of the mattress 20 such that the liner 32 of the absorbent pad 30 is disposed within the catchment aperture 22 of the mattress 20. Once the absorbent pad 30 is positioned on the mattress 20, the catchment insert 40 is disposed over the pad 30, such that the catchment bag 42 is disposed within the catchment liner 32.

Once assembled, the bedridden person may lie on the mattress 20 such of the person's anus and, in the case of a female, urethra are positioned substantially over the center of the catchment aperture 22. Accordingly, when the person has a bowel movement, the bowel movement is received via gravity within the primary catchment bag 42 and is thus separated from the skin of the bedridden. As is further discussed herein, the catchment insert 40 may then be removed and replaced with minimal movement of the person. In operation, the system 10 provides, in various configurations, a multiple layer catchment system that improves sanitation and reduces caregiver cleaning requirements associated with diaper usage. Each of the components of the exemplary fecal catchment system 10 are further discussed below.

In the exemplary embodiment, the mattress 20 is a standard size single bed 37 inches wide and 78 inches long. However, differently sized mattresses may be utilized. Modern mattresses are made with varying thickness and, in some instances, with resistance layers of foam or memory foam. The catchment aperture 22 is a recess in the mid portion of the mattress. (e.g., between the sides and between the head and foot of the mattress) between a top surface 24 and a bottom surface 25. In the present embodiment, the catchment aperture has a width of approximately 5" and length of approximately 7". Though illustrated as a rectangular aperture, it will be appreciated that the catchment aperture may have other configurations (e.g., oval, round, square etc.). Typically, the catchment aperture 22 will be elongated and will measure between 5" to 7" wide by 7" to 12" inches long, depending on the size, weight and position required by the individual. Mattresses depth can vary but optimal performance is achieved when the catchment aperture is at least 8" deep to receive the insert(s) of the fecal catchment system. The catchment aperture need not extend through the mattress between its top and bottom surfaces. That is, the bottom of the catchment aperture 22 may be closed. In other embodiments, the catchment aperture 22 may extend through the bottom surface of the mattress.

The mattress conforms to standards as set forth by 16 CFR §1633, which is required for all mattresses made and sold in the United States. For instance, for burn testing the top cover must extend over the surface of the mattress and continue into the catchment aperture to line it with the same fire rated material. As noted, the mattress and/or catchment aperture 22 may further include an additional application of a polyethylene or other protective coating to keep it from being soiled. In use, a standard bed mattress pad (not shown) that covers the entirety of the mattress 20 may be prepared with an aperture to match the size and shape of the catchment aperture. Likewise, a bed sheet may be manufactured with an aperture to match the size and shape of the catchment aperture and is placed over the mattress pad.

As more fully discussed below, the catchment bag 42 of the catchment insert 40 and the liner 32 of the absorbent pad (if utilized) are designed for application and removal through the top surface of the mattress 20, thereby eliminating the need to access the underside of the mattress. In this regard, the fecal and urinary management system may be utilized without specialized bed frames or supports. This allows the management system for the bedridden to be readily utilized for in-home application without purchase of expensive medical bedding systems. As shown, the mattress may be supported by a standard box spring 28, though any appropriate support structure may be utilized.

The absorbent pad 30 having the catchment liner 32 may be constructed of materials that facilitate the absorption waste materials while resisting the passage of waste material though the absorbent pad 30. The absorbent pad 30 may be sized such that the width of the pad 30 substantially corresponds to the width of mattress 20. In one embodiment, the absorbent pad 30 has a length of about 30 inches. However, this is not a requirement and the size may vary. In any case, the absorbent pad 30 provides a protective cover over a portion of the mattress 20. Further, as discussed below, the absorbent pad 30 may be removed if it becomes soiled without necessitating removal of the bedridden person from the mattress 20.

The absorbent pad 30 is configured with an aperture 34 defined substantially within its center. In the present embodiment, the aperture 34 is illustrated with a substantially rectangular shape, however, other configurations are possible. Generally, the size of the aperture 34 corresponds with the size of the aperture in the mattress 20. The catchment liner 32 has a first open end attached around the periphery of the aperture 34. The catchment liner 32 may constructed of polyethylene or any other non permeable material that is known to those having ordinary skill in the art. The second end of the catchment liner 32 is closed such that the catchment liner 32 defines a cavity between its open and closed ends. Generally, the length of the catchment liner 32 between the closed and open ends is at least as long as the depth of the catchment aperture. In this regard, the closed/bottom end of the catchment liner 32 may rest on a support surface (e.g., bottom of the catchment aperture 22, top of the box spring 28, etc) supporting the mattress 20. However, in other embodiments, the bag may be suspended.

If the absorbent pad 30 becomes soiled, the pad may be replaced without removing the person from the mattress 20. That is, a caregiver could roll the person onto their side such that they are located on one side of the mattress 20. The caregiver may then gather and compact half of the absorbent pad 30. The caregiver may then place a replacement absorbent pad 30 onto mattress 20 and position half of the replacement pad on the mattress 20. The person may then be rolled onto their other side such that they are located on the opposite side of mattress 20. The caregiver may then withdraw the used absorbent pad 30 and its catchment liner 32 and roll out the remaining portion of the replacement absorbent pad 30 and insert the replacement catchment liner 32 in the catchment aperture 22. The person may then be repositioned placed such that the bedridden person's anus is positioned substantially over the mattress aperture 22.

Figure 3A:
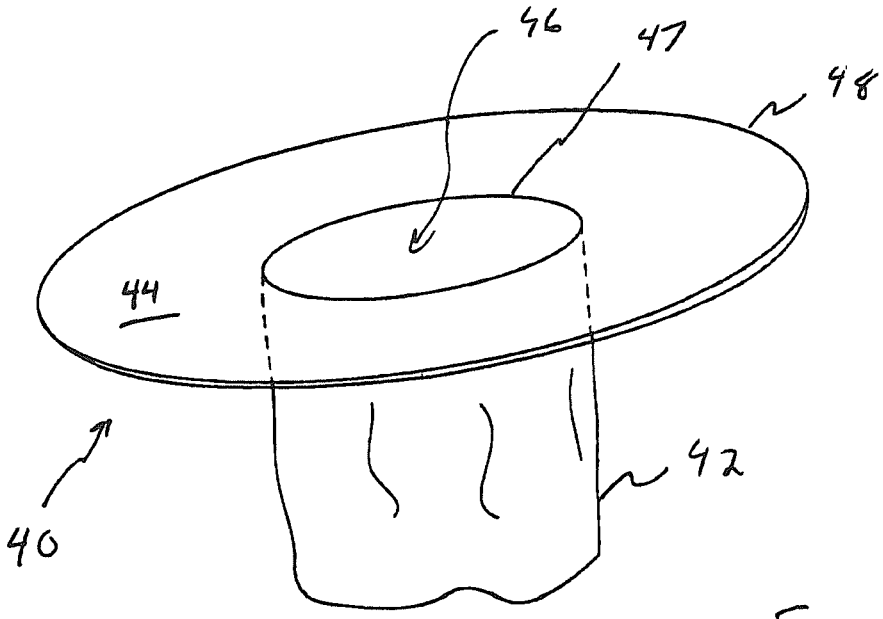
FIG. 3A illustrates a perspective view of a catchment insert.

While the system may functional with only the absorbent pad 30 and its catchment liner 32 being used as a catchment bag for bodily wastes, the removal and replacement of the pad 30 is physically intensive for both the caregiver and the bedridden. That is, it is desirable to reduce or eliminate the requirement that a patient be rolled side to side to replace a soiled catchment bag. To reduce the need to replace the absorbent pad 30 after each urinary or bowel movement of the person, the preferred system further incorporates the catchment insert 40. As shown, catchment insert 40 includes an annular platform 44 having a central aperture 46. See FIG. 3A. The primary catchment bag 42 is attached around the periphery 47 of the central aperture 46. The annular platform 44 is preferably formed of a flexible material such that it may be folded and or bent to facilitate insertion of the catchment insert 40, as is more fully discussed below.

In one embodiment, the central aperture 46 of the annular platform 44 has a size that exceeds the catchment aperture 22 of the mattress and/or the secondary catchment liner 32 of the absorbent pad 30. In the illustrated embodiment, an outer periphery 48 of the annular platform 44 corresponds in shape to the periphery 47 of the central aperture 46. However, it will be appreciated that the shape of these peripheries may differ. In any case, it is desirable that a width of the annular platform measured between the peripheries 47, 48 be at least two to three inches. In this regard, the annular platform 44 provides sufficient surface area to maintain the annular platform about the catchment aperture 22. Stated otherwise, the platform 44 has a sufficient size and/or attachment to resist being pulled into the catchment aperture 22. Further, the annular platform may be semi-rigid to further resist being pulled into the catchment aperture.

Figure 3B:
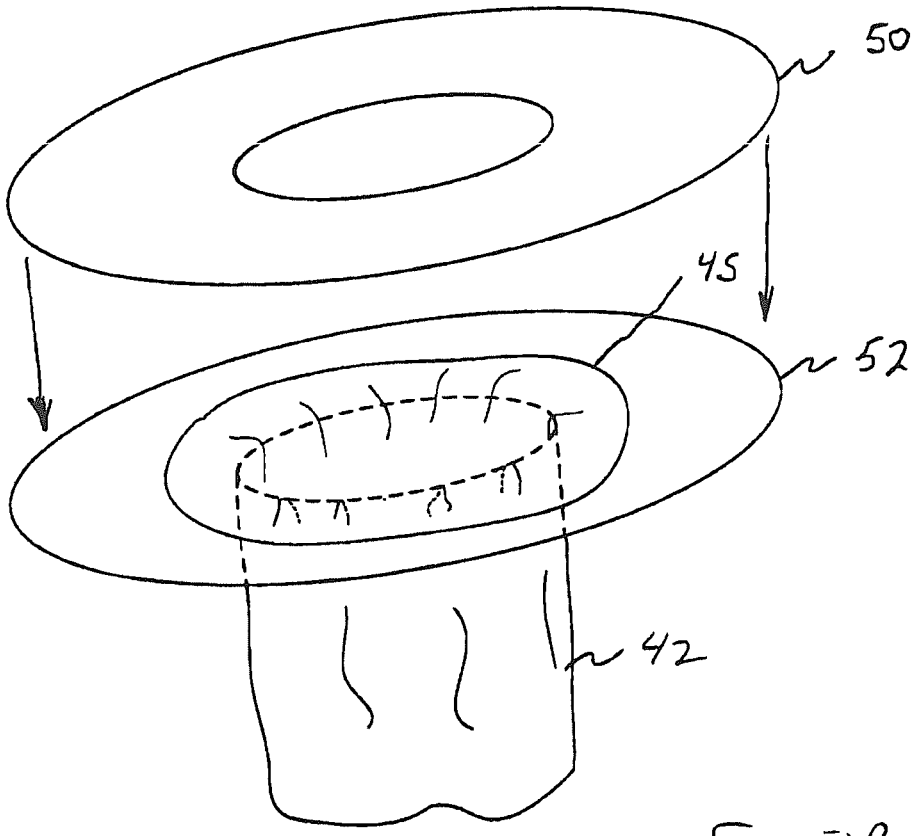
FIG. 3B illustrates a perspective exploded view of the catchment insert.

In one embodiment, the top surface of the annular platform 44 further comprises an absorbent material/pad. Such a padded surface may allow for absorbing bodily wastes that come into contact with the catchment insert 40 and thereby reduce the frequency required to replace the absorbent pad 30, which in some embodiments underlies the catchment insert 40. In such an embodiment, the annular platform 44 may be formed of a first upper annular member 50 and second lower annular member 52. In this embodiment, a periphery 45 of the open end of the catchment bag 42 may be disposed between the upper and lower annular members 50, 52. See FIG. 3B. In various embodiments, the bottom side of the annular platform 44 may include adhesive tabs that allow for securing the annular platform 44 to the surface of the mattress 20 and/or absorbent pad 30.

The use of the catchment insert 40 significantly reduces the number of times that the absorbent pad 30 has to be changed. That is, if the pad 30 is not soiled after a urinary or bowel movement, a caregiver only needs to remove the catchment insert 40 and the primary catchment bag 42. Specifically, the flexible annular platform 44 of the catchment insert 40 may be slid from beneath the buttocks of the bedridden person, folded and removed between the legs of the person. At this time a fresh catchment insert 40 and catchment bag 42 may be inserted to replace the one that has just been taken out and disposed of in a trash receptacle. The procedure for replacement of the catchment bag 42 is to slide the insert 40 with attached bag 42 between the legs and insert it into the catchment aperture 22 for the next use. As will be appreciated, this process eliminates the need to roll the person side to side as may be required to replace the absorbent pad 30. This reduces the physical requirements needed to change the catchment bag for both the caregiver and the bedridden person In a further embodiment, the catchment insert 40 may include a roll of catchment bags 56 in addition to the catchment bag 42. See FIG. 4. This roll of catchment bags 56 may be similar to a roll of trash bags where individual bags are rolled together. As a user draws one bag 56*a*, the next bag 56*b* in the roll 56 unwinds from the roll and is available for use. In this arrangement, an open end of the first bag 56*a* may be disposed over and around the top surface of the annular platform 44 such that the open end of the bag 56*a* is disposed beneath the outer periphery of the annular platform 44. This first bag 56*a* may be held in position by adhesive tabs or other fasteners (not shown) disposed on the bottom surface of the annular platform 44. In such an arrangement, once the first bag 56*a* is soiled, a caretaker may gather the open end of the first bag 56*a* and remove the bag from the catchment bag 42. Once removed, an open end of the second bag 56*b* may be disposed over and around the outer periphery of the annular platform 44. As will be appreciated, this arrangement further reduces the need to move the bedridden.

Figure 4:
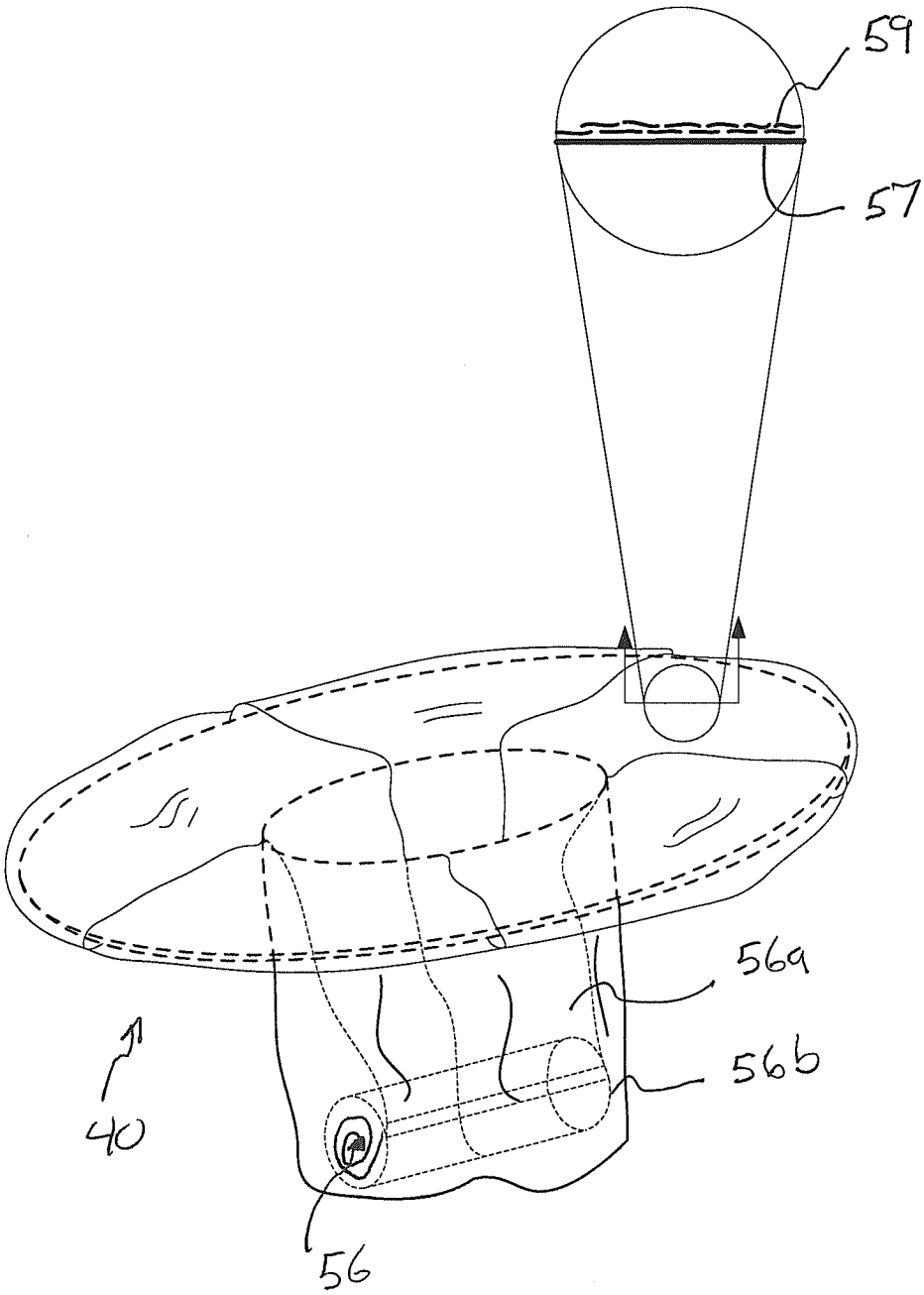
FIG. 4 illustrates a perspective view of another embodiment of a catchment insert.

As shown in the enlarged cut-away cross-section of FIG. 4, it may be further desirable that the interior surface of the catchment bags 56 be multi-layered. Specifically, the bags 56 may include a non-permeable layer 57 and a breathable permeable layer 59. As will be appreciated, when the open end of the bag 56 is positioned over and around the annular platform, a bedridden individual will rest on the top surface of the annular platform 44 and, hence, the surface of the bag 56 disposed over the platform. Direct contact with a non-permeable surface (e.g., plastic) is undesirable as such contact may result in bed sores or ulcers as there is no airflow. Accordingly, the interior of the bags may be lined with a permeable liner 59. Such a liner may be made of any appropriate material including, without limitation, papers, fabrics, synthetics etc. what is important, is that the surface of the bag 56 on which a patient rests provides some permeability.

Figure 5:
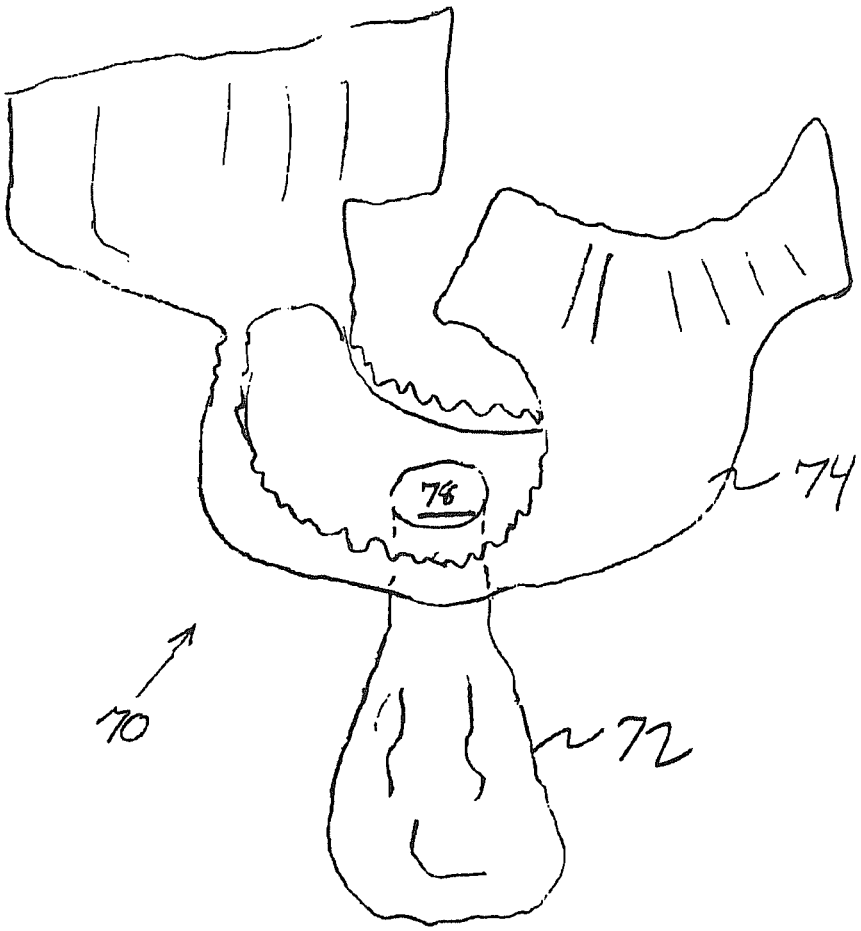
FIG. 5 illustrates a perspective view of a wearable catchment insert.

In a further embodiment, the catchment insert may be configured to be worn by the bedridden person. As illustrated in FIG. 5, such a wearable catchment insert 70 may be configured as a modified diaper 74. In this arrangement, the modified diaper 74 may be adapted to include a catchment bag 72, which may be disposed within the interior of the secondary catchment bag of the absorbent pad and/or within the interior of the primary catchment bag of the platform catchment insert. As shown, an open end 78 of the catchment bag 72 extends through the bottom surface of the modified diaper 74 such that it is positioned proximate to the anus of a person. Accordingly, a majority of fecal waste may pass through the aperture and fall into the catchment bag 72. This again results in the separation of bodily waste from the skin of the bedridden person. Such a wearable catchment insert 70 may advantageously be utilized with persons who do not remain immobile while in bed. That is, the wearable catchment option is provided for persons who are unable to stay in a supine position.

In any of the embodiments discussed above, absorbent material may be disposed within the various catchment bags. For instance, a hydrophilic gel cell may be placed into the bottom of the catchment bags to absorb urine.

In summary, the fecal and urinary management system works as follows: with a mattress cover and bed sheet placed on the mattress, a user (e.g., caregiver or an ambulatory person) the catchment insert bag 42 of the catchment insert 40 into the catchment aperture 22 of the mattress 30. The insert 40 is placed over and around the aperture 22 in the mattress and may be fixed in place, for example by attaching sticky the tabs, or other attachment mechanism, at each corner.

To engage the mattress, the person will sit on the edge of the bed and pivot on the bed to become centered over the catchment aperture. For patients who lack mobility, the patient may remain supine on the bed. Typically a pillow will be placed in a position of comfort under the head of the bedridden. Alternatively, when utilized with a medical bed that allows for elevating the torso of a patient, the patient may elevated to a semi-sitting position to assist in bowel functioning. In any arrangement, a gown with and opening at the back works best for bedridden care clothing. If the person is already on the bed, the insert with disposable bag attached is placed into the aperture by simply spreading the legs apart and inserting the catchment insert into the opening. No lifting of, or moving of, the bedridden person is required in the case of the catchment insert 40.

The person may now be verified as being centered over the aperture in the covers and mattress and catchment insert. When a bowel movement occurs, it works best with the back of the bed elevated to a near sitting position if feasible. The legs should be spread apart to a 45 degree angle toward each side of the foot of the bed. Three forces are now available to cause a bowel movement to occur: involuntary peristaltic muscle contraction—urge; voluntary muscle contractions by the bedridden—push; and gravity pulling the discharge into the sack—drop. Any, or all of these forces in combination, cause the bowel movement to be captured in the disposable bag. At this time a caregiver or the person may utilize toilet tissue or wipes and then deposit these materials into the catchment bag. In the case of the catchment insert, a bedridden person or caregiver may simply reach down between the legs and take hold of the annular platform, pull it out (in the direction the feet of the person) and lift out the insert catchment bag with its contents. The catchment inset may then be closed and put it into a disposal receptacle. In the same way, a fresh catchment insert may be installed. The bedridden person may then return to the original supine position on the back. The new insert system is now in place for the next use.

The fecal and urine management system 10 functions particularly well for female persons as the anus and urethra are positioned substantially over the center of the catchment aperture 22. However, difficulties arise for male persons. Specifically, the urine discharge from the penis of a male is not naturally directed down when the male person is supine. The penis frequently is directed in ways that wet the surrounding clothing and or mattress and miss the catchment system. Accordingly, catching and containing urine of male persons continues to be problematic. To capture male urine discharge, two alternate remedies are provided.

Figure 6:
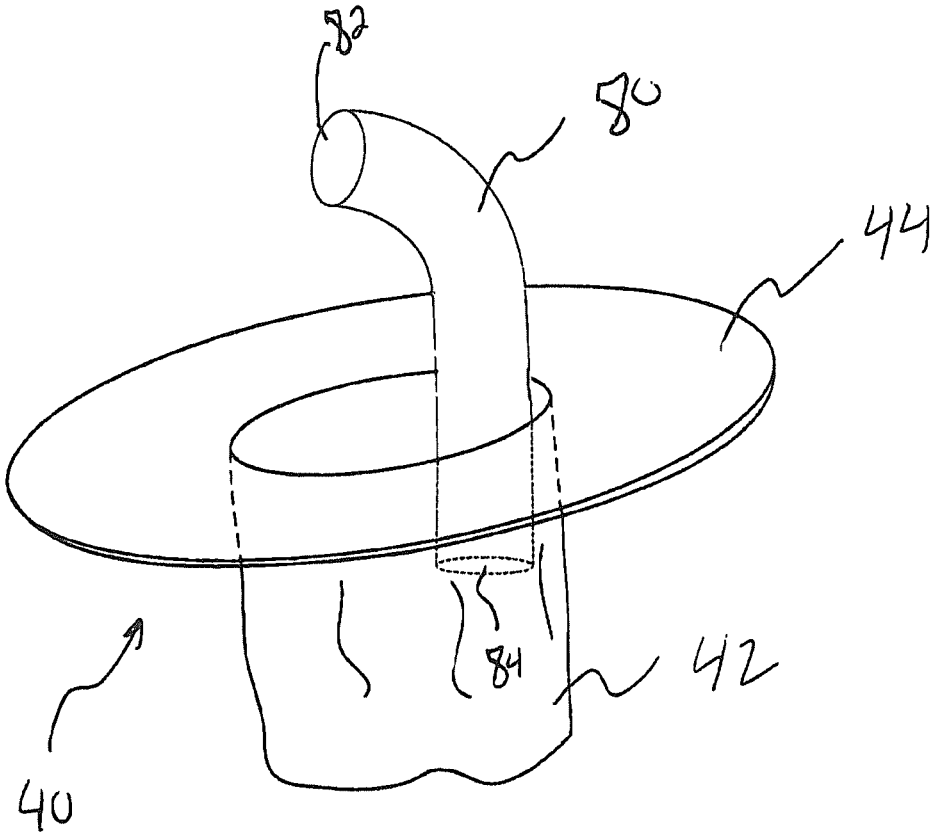
FIG. 6 illustrates a perspective view of a further embodiment of a catchment insert.

FIG. 6 illustrates a modified catchment insert 40. As shown, the catchment insert 40 further includes a discharge tube 80, which may be attached to the annular platform 44. In this embodiment, an inlet end 82 of the discharge tube 80 may envelop the penis. The inlet end may be affixed (e.g., taped) to the bedridden male. A discharge end 84 of the discharge tube may be disposed within the interior of the catchment bag 42.

Figure 7:
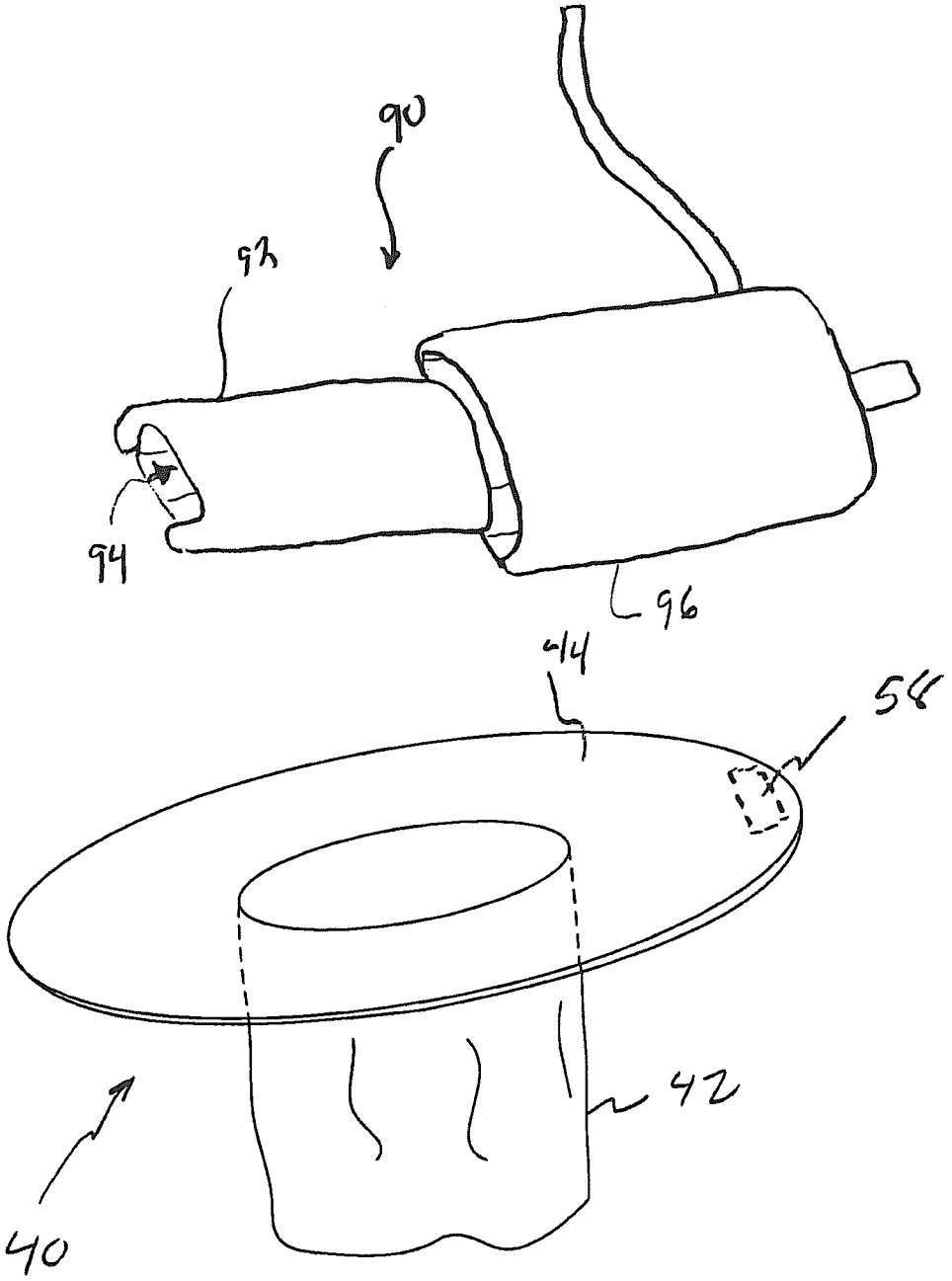
FIG. 7 illustrates a perspective view of a catchment insert having a scrotal diaper for male patients.

In another embodiment, the penis of a bedridden male may be disposed within a scrotal diaper 90. See FIG. 7. In this embodiment, a scrotal diaper 90 is adapted to envelop the penis and scrotum of the bedridden male. As shown, The scrotal diaper 90 includes a urine insert 92, which preferably has an internal urine gel cell that is designed to capture approximately 800 cc of urine. The insert 92, has an open end 94 that is sized to receive the penis and scrotum of a male patient. In the illustrated embodiment, the insert 94 is sized for receipt within a pouch 96. Once the insert is wetted, the insert may be removed from the pouch and replaced with a fresh insert. The pouch 96 may be made of a fabric such that it may be washed when necessary. To maintain the correct positioning of the scrotal diaper, the pouch further includes an attachment strap 98 that may be connected to the annular platform 44 of the catchment insert 40. The attachment strap may include a Velcro connector, snap or other attachment means that affixes to an attachment point 58 on the upper or lower surface of the annular platform 44. In addition, the pouch may include a second attachment strap 100 which may connect around a leg of the patient to maintain correct position of the pouch and insert relative to the patient. As will be appreciated, use of the male scrotal diaper prevents wetting of the bed.

The foregoing description has been presented for purposes of illustration and description. Furthermore, the description is not intended to limit the inventions and/or aspects of the inventions to the forms disclosed herein. Consequently, variations and modifications commensurate with the above teachings, and skill and knowledge of the relevant art, are within the scope of the presented inventions. The embodiments described herein above are further intended to explain best modes known of practicing the inventions and to enable others skilled in the art to utilize the inventions in such, or other embodiments and with various modifications required by the particular application(s) or use(s) of the presented inventions. It is intended that the appended claims be construed to include alternative embodiments to the extent permitted by the prior art.

What is claimed is:

1. A fecal and urinary management system for use with bedridden persons, comprising:

a mattress having a top surface and a bottom surface, said mattress further including a catchment aperture extending through said top surface in a mid portion of said mattress, said catchment aperture having a depth that is at least half of the distance between said top surface and said bottom surface;

an absorbent pad having an pad aperture, wherein said absorbent pad is disposed on said top surface of said mattress extending between lateral edges of said mattress and said pad aperture is at least partially disposed about said catchment aperture;

a non-permeable liner having an open end attached about said pad aperture and a closed end, wherein said liner is disposed within said catchment aperture of said mattress;

a semi-rigid annular platform with an inside periphery defining an aperture and an outside periphery, wherein said semi-rigid annular platform is disposed on said top surface of said mattress and said inside periphery defining said aperture is at least partially disposed about said catchment aperture and said pad aperture; and a roll of non-permeable catchment bags disposed within said non-permeable liner within said catchment aperture wherein each catchment bag includes an open end and a closed end, wherein an open end of an end bag of said roll of bags is adapted to be fit through said aperture of said semi-rigid annular platform, extend over a top surface of said semi-rigid annular platform and adhere to a bottom surface of said semi-rigid annular platform.

2. The system of claim 1, wherein said catchment aperture has a depth of at least eight inches.

3. The system of claim 1, wherein said catchment aperture extends through said mattress.

4. The system of claim 1, wherein said catchment aperture has a maximum width between about 5 inches and 7 inches and a maximum length of between about 7 inches and 12 inches.

5. The system of claim 1, wherein said catchment aperture is located in said top surface of said mattress approximately halfway across a width of the mattress and approximately halfway between a head and a foot of the mattress.

6. The system of claim 1, wherein said annular platform has a minimum width between said inside periphery and said outside periphery of about 2 inches.

7. The system of claim 1, wherein said semi rigid annular platform resists disposition within said catchment aperture and allows folding of said platform during insertion and removal of said catchment bag in said catchment aperture.

8. The system of claim 1, wherein said catchment insert further comprises:

a roll of bags disposed in said catchment bag, wherein each bag includes an open end and a closed end, wherein an open end of an end one of said roll of bags is adapted to be fit over and around said annular platform.

9. The system of claim 1, wherein said catchment insert further comprises at least one of:

a discharge tube having an inlet end adapted to envelop a penis of a male patient and a discharge end disposed in said catchment bag; and a scrotal diaper having an open insertion end adapted to envelop a penis and scrotum of a male patient and a closed and adapted for attachment to said annular platform.

10. A fecal and urinary management system for use with bedridden persons, comprising:

a mattress having a top surface and a bottom surface, said mattress further including a catchment aperture and catchment recess extending through said top surface in a mid portion of said mattress, said catchment recess having a depth that is at least half of the distance between said top surface and said bottom surface;

an absorbent pad having an pad aperture, wherein said absorbent pad is disposed on said top surface of said mattress extending between lateral edges of said mattress and said pad aperture is at least partially disposed about said catchment recess;

a non-permeable liner having an open end attached about said pad aperture and a closed end, wherein said liner is disposed within said catchment recess of said mattress;

a semi-rigid annular platform, having:

an upper annular member having an absorbent top surface and a bottom surface;

a lower annular member having a top surface and a bottom surface disposable on said top surface of said mattress; and a catchment bag having an open end disposed between said upper annular member and said lower annular member and secured about inside peripheries of apertures in said annular members, wherein said bottom surface of upper annular member and said top surface of said lower annular member are connected and said apertures of said annular members collectively define an annular platform aperture at least partially disposed about said catchment aperture and said pad aperture, and wherein said catchment bag is disposed within said non-permeable liner within said catchment recess.

* * * * *